United States Patent [19]

Akesaka

[11] Patent Number: 5,013,189

[45] Date of Patent: May 7, 1991

[54] INTERMEDIATE PIPE-JACKING APPARATUS

[75] Inventor: Toshio Akesaka, Yokohama, Japan

[73] Assignee: Kabushiki Kaisha Iseki Kaihatsu Koki, Tokyo, Japan

[21] Appl. No.: 510,616

[22] Filed: Apr. 18, 1990

[30] Foreign Application Priority Data

Apr. 28, 1989 [JP] Japan ..... 1-107365

[51] Int. Cl.[5] ..... F16L 1/028; E21D 9/06

[52] U.S. Cl. ..... 405/184; 405/146

[58] Field of Search ..... 405/134, 142, 146, 154, 405/184

[56] References Cited

U.S. PATENT DOCUMENTS

| | | | |
|---|---|---|---|
| 3,708,984 | 1/1973 | Coleman | 405/184 X |
| 4,315,701 | 2/1982 | Ivanov et al. | 405/146 X |
| 4,322,182 | 3/1982 | Ostgaard | 405/184 X |
| 4,626,134 | 12/1986 | Coumont | 405/184 |
| 4,808,030 | 2/1989 | Takegawa | 405/146 |

FOREIGN PATENT DOCUMENTS

| | | | |
|---|---|---|---|
| 0021702 | 1/1981 | European Pat. Off. . | |
| 1243231 | 6/1967 | Fed. Rep. of Germany | 405/184 |
| 1251789 | 10/1967 | Fed. Rep. of Germany | 405/184 |
| 2720039 | 11/1978 | Fed. Rep. of Germany . | |
| 63-156292 | 10/1988 | Japan . | |
| 999822 | 7/1965 | United Kingdom | 405/184 |

*Primary Examiner*—David H. Corbin

*Attorney, Agent, or Firm*—Ware, Fressola, Van der Sluys & Adolphson

[57] ABSTRACT

An intermediate pipe-jacking apparatus is adapted to propel pipes such as sewer pipes, conduit pipes and the like in the ground between a start shaft and a destination shaft in order to install the pipes in the ground. More specifically, the intermediate pipe-jacking apparatus disposed between the pipes to be propelled comprises a movable frame disposed inside the pipes, a plurality of hydraulic jacks supported by the frames, and an operating mechanism for shifting the hydraulic jacks between the operative position between the end faces of the pipes and the inoperative position inside the pipes, wherein the frame is provided with a pair of hollow end frame members, and a plurality of rod members rotatably supported by the respective end frame members, and each rod member is pivoted by the operating mechanism so as to displace the hydraulic jacks between the operative position and the inoperative position.

9 Claims, 6 Drawing Sheets

INTERMEDIATE PIPE-JACKING APPARATUS

BACKGROUND OF THE INVENTION

1. Field of the Invention

This invention relates to an apparatus for propelling pipes such as sewer pipes, conduit pipes and the like in the ground between a start shaft and a destination shaft in order to install the pipes in the ground and, more particularly, to an intermediate pipe-jacking apparatus removably disposed between the pipes to be propelled in order to compensate for a thrust of a basic pipe-propelling apparatus installed in the start shaft.

2. Description of the Prior Art

An intermediate pipe-jacking apparatus is adapted to propel a group of pipes in front of the intermediate pipe-jacking apparatus with a reaction borne by another group of pipes at the rear of the intermediate pipe-jacking apparatus. Such intermediate pipe-jacking apparatus is composed of hydraulic jacks and a support for supporting the hydraulic jacks. After the completion of propulsion of the pipes, the intermediate pipe-jacking apparatus is removed. Then, a space between the pipes resulting from the removal of the intermediate pipe-jacking apparatus is eliminated by propelling the rear group of pipes relative to the front group of pipes by the use of a basic pipe-propelling apparatus.

A conventional intermediate pipe-jacking apparatus as disclosed in Japanese Utility Model Public Disclosure (KOKAI) No. 63-156292 permits a plurality of hydraulic jacks to respectively shift from the position between the end faces of the adjacent front and rear pipes to the inside of the pipes of the support installed in the pipes. After the completion of propulsion of the pipes, the conventional pipe-jacking apparatus.

However, each of the conventional apparatuses including the apparatus disclosed in the above Public Disclosure occupies essentially the entire cross section of the pipe, in which the apparatus is installed, so that laser beams used for controlling the propulsion are hindered. Also, in pipes having a bore large enough to permit the operator to enter therein, it is advantageous if the operator can move through the intermediate pipe-jacking apparatus for the purpose of the removal, or the maintenance and inspection of the intermediate pipe-jacking apparatus or the adjacent pipes. However, the conventional intermediate pipe-jacking apparatus does not permit to the operator to carry out the above actions due to the structure as noted above.

Further, since the space between the pipes needs to be eliminated by the operation of the basic pipe-propelling apparatus after the removal of the intermediate pipe-jacking apparatus, the time needed to remove the basic pipe-propelling apparatus after an arrival of leading pipe at the destination shaft varies depending upon the time taken for the removal of the intermediate pipe-jacking apparatus. Accordingly, while the time taken to remove the intermediate pipe-jacking apparatus should desirably be shortened, the conventional intermediate pipe-jacking apparatus is of a type, having a plurality of hydraulic devices which are individually shifted inward of the pipe, so as not to satisfy this need at least with respect to controllability.

SUMMARY OF THE INVENTION

It is an object of the present invention to overcome the conventional drawbacks as noted above, and to ensure that a space is defined in the center of the cross section of the pipe with an intermediate pipe-jacking apparatus being installed in the pipe.

Another object of the present invention is to permit the intermediate pipe-jacking apparatus to be easily and rapidly removed.

An intermediate pipe-jacking apparatus according to the present invention includes a frame composed of a pair of hollow end frame members each of which is located in the cross section of each pipe to be propelled and has a configuration substantially conforming to the inner peripheral surface of the pipe, and a plurality of rod members rotatably supported by the respective end frame members. A plurality of hydraulic jacks supported by the frame and adapted to propel the pipes are respectively fixed to the rod members, and an operating mechanism disposed substantially along one of the end frame members makes the rod members pivot so as to shift the hydraulic jacks between the operative position and the inoperative position of the hydraulic jacks.

Also, the operating mechanism is provided with a bracket fixed to one end of each of the rod members, and at least one operating jack and a plurality of connecting members for interconnecting the adjacent brackets.

According to the present invention, the frame for supporting the hydraulic jacks has a space defined in the center of the cross section of the frame. Also, the operating mechanism for shifting the hydraulic jacks between the operative position and the inoperative position is disposed along the frame and maintains the space in the center of the cross section of the operating mechanism. Accordingly, the operator or material entering or exiting the space are not hindered by the obstacle of the frame.

Also, the rod members constituting the frame are simultaneously rotated by the operation of the jack constituting the operating mechanism, and the hydraulic jacks adapted to propel the pipes are shifted at a time from the operative position to the inoperative position. Thus, the intermediate pipe-jacking apparatus is easily and rapidly removed.

BRIEF DESCRIPTION OF THE DRAWINGS

The foregoing and other objects and features of the invention will become apparent from the following description of a preferred embodiment of the invention with reference to the accompanying drawings, in which:

FIG. 6(*b*) is an enlarged view similar to that of FIG. 6(*a*), but showing a modification of the portion shown in FIG. 6(*a*).

DETAILED DESCRIPTION OF THE PREFERRED EMBODIMENT

Figure 1:
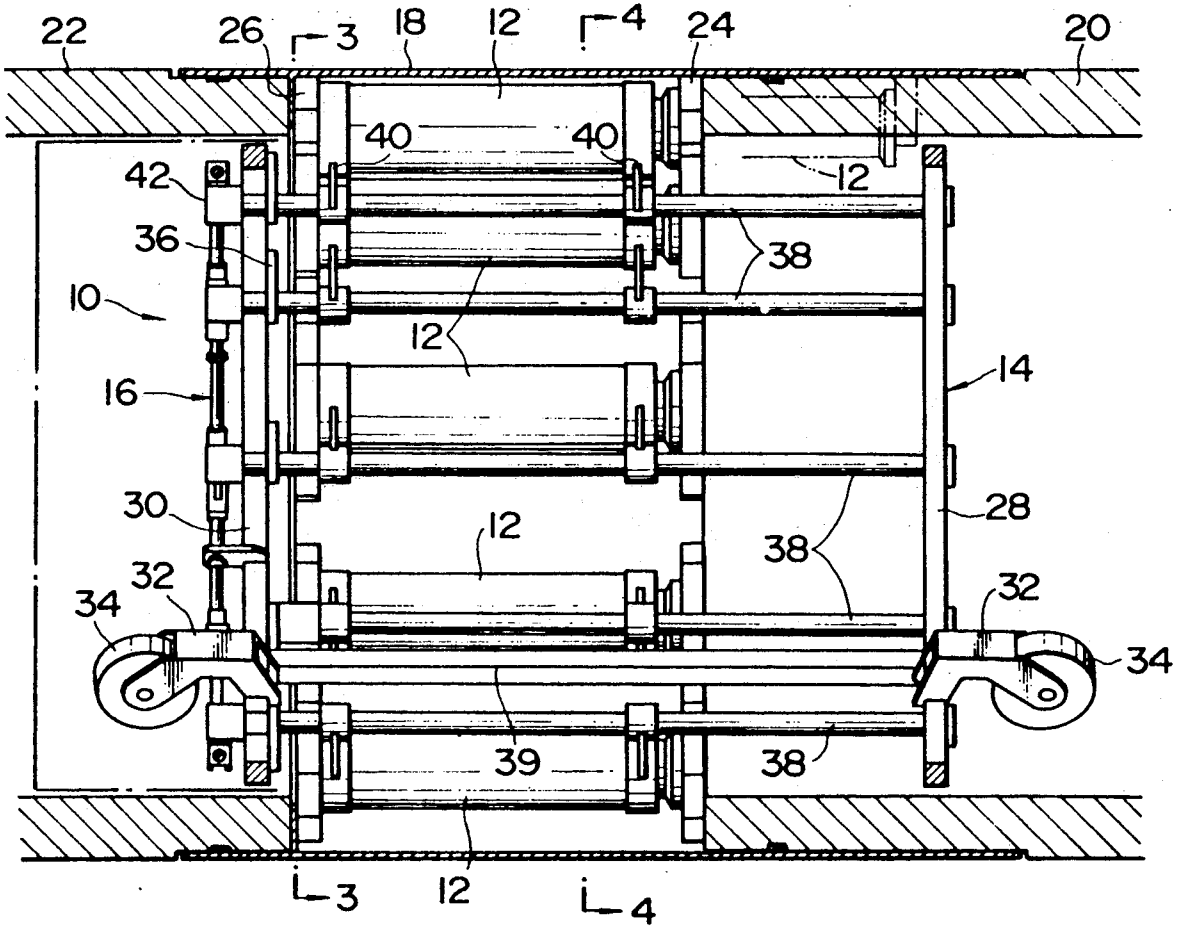
FIG. 1 is a fragmentary elevation showing an intermediate pipe-jacking apparatus according to the present invention, which is in an operative condition inside pipes.

FIG. 1 shows an intermediate pipe-jacking apparatus 10 according to the present invention which is in an operative condition. Referring to FIG. 1, the intermediate pipe-jacking apparatus 10 comprises a plurality of hydraulic jacks 12, a frame 14 for supporting the hydraulic jacks 12, and an operating mechanism 16 for shifting the hydraulic jacks 12 between the operative position and the inoperative position of the jacks 12.

When the intermediate pipe-jacking apparatus 10 is in the operative condition, the hydraulic jacks 12 are respectively placed at the operative position, i.e., the position surrounded with a collar 18 on the outer periphery and between the end faces of a pair of pipes 20,22 adjacent to each other in the propelling direction, as shown in FIG. 1. Each hydraulic jack 12 in the operative position permits pipe 22 to bear reaction and the other pipe 20 to be propelled forward (rightward in the drawing) through press plates 24,26 respectively mounted on the front and rear ends of the hydraulic jacks 12.

The frame 14 supports the hydraulic jacks 12 to be propelled. Ten hydraulic jacks 12 in total are used in the illustrated embodiment, and five out of ten hydraulic jacks 12 are shown in FIG. 1. As shown in the drawing, the intermediate pipe-jacking apparatus 10 in the operative condition is disposed inside the pipes 20,22 so as to span the pipes 20,22.

The frame 14 includes a pair of end frame members 28,30 disposed at an interval. Each of the end frame members 28,30 is located in the cross section of each of the pipes 20,22 and takes the generally circular form (See FIG. 2) substantially conforming the inner peripheral surface of the corresponding pipe. Each end frame member can be formed of not only one or a plurality of shape steel materials as shown in the drawing, for example, but also a ring (not shown) resulting from punching out of a metal sheet.

Figure 2:
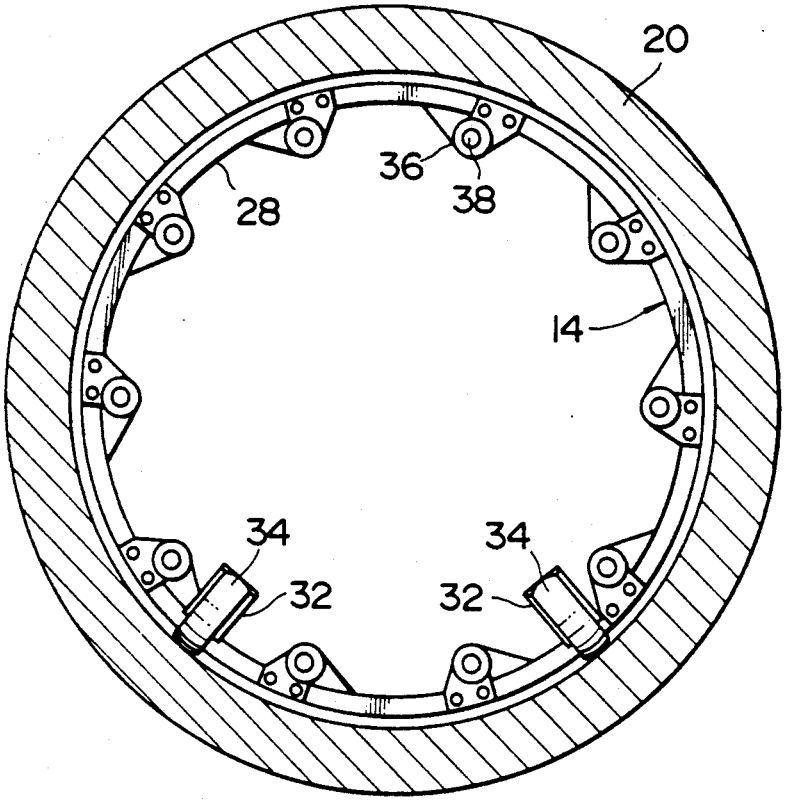
FIG. 2 is a right end view showing the intermediate pipe-jacking apparatus shown in FIG. 1.

Wheels 34 are mounted on each end frame member through brackets 32 to permit the frame 14 to move. In the illustrated embodiment, the end frame members 28,30 are respectively provided with a pair of wheels 34, as shown in FIGS. 2 and 3.

The frame 14 further includes a plurality of rod members 38 and reinforcing members 39. The rod members 38 extend in parallel to each other between the end frame members 28,30 and are respectively mounted on the frame members as being rotatably supported by corresponding bearings 36.

Each hydraulic jack 12 is fixed to an associated rod member 38 through a pair of front and rear mounting members 40 such that each hydraulic jack 12 can be rotated by a predetermined angle together with its associated rod member. Each of the end frame members 28,30 is permitted to take a polygonal form, instead of the circular form. This means that each end frame member is formed into the decagon corresponding to the number of hydraulic jacks 12, i.e., the number (i.e., 10) of rod members 38. In the case where each end frame member takes not only the circular form, but also the polygonal form, a wide hollow region is defined in the center of the cross section of the intermediate pipe-jacking apparatus 10.

Figure 3:
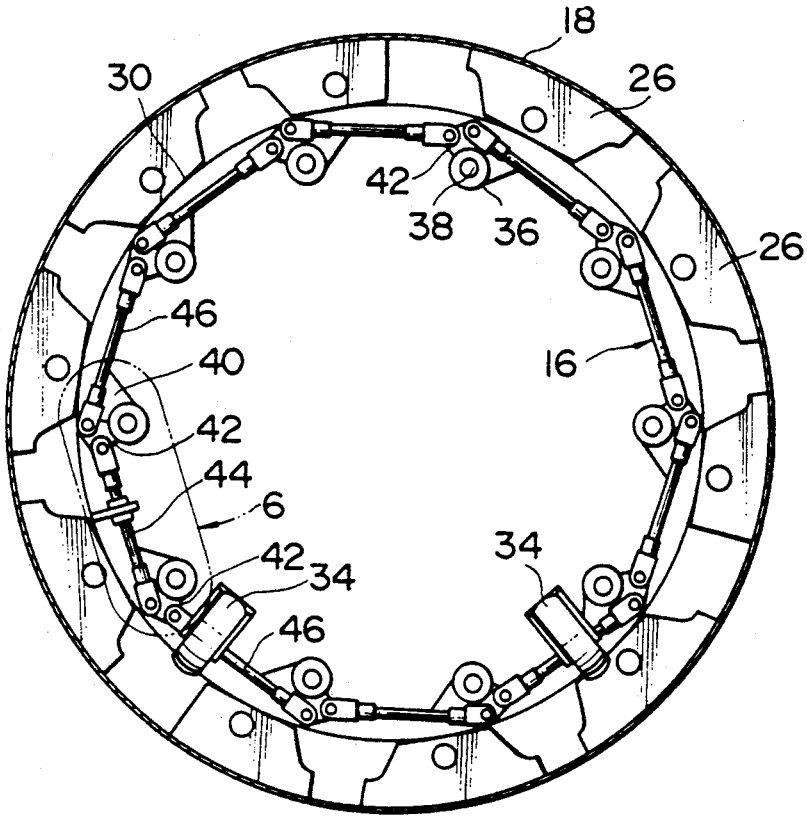
FIG. 3 is a sectional view taken along a line 3—3 in FIG. 1.

The operating mechanism 16 is adapted to shift the hydraulic jacks 12 between the operative position (shown by the solid line in FIGS. 1 and 4) between the end faces of the pipes 20,22 and the inoperative position (shown by the broken line in FIG. 4 and by the solid line in FIG. 5) inside the pipes 20,22, and includes a bracket 42 fixed to one end (left end in FIG. 1) of each rod member 38, and, an operating jack 44 and a plurality of connecting members 46 for connecting the adjacent brackets to each other as shown in FIG. 3.

Figure 6A:
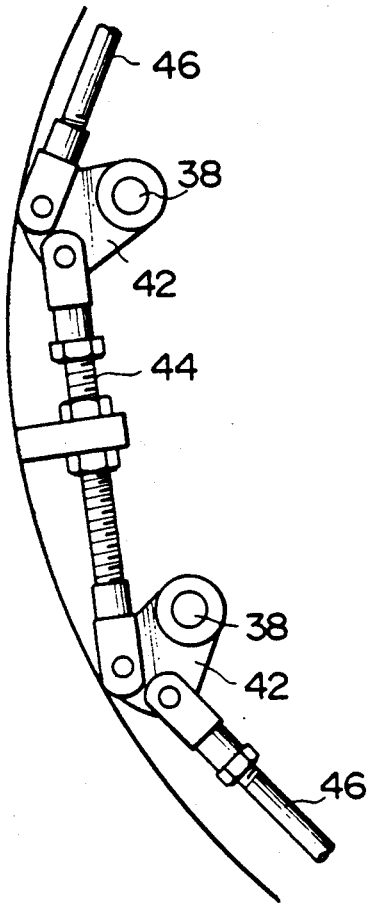
FIG. 6(*a*) is an enlarged view showing a portion indicated by an arrow 6 of FIG. 3.
Figure 6B:
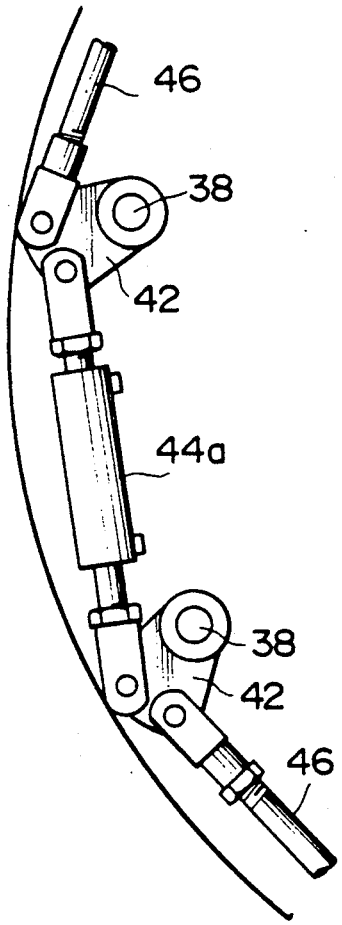
Figure 6B:
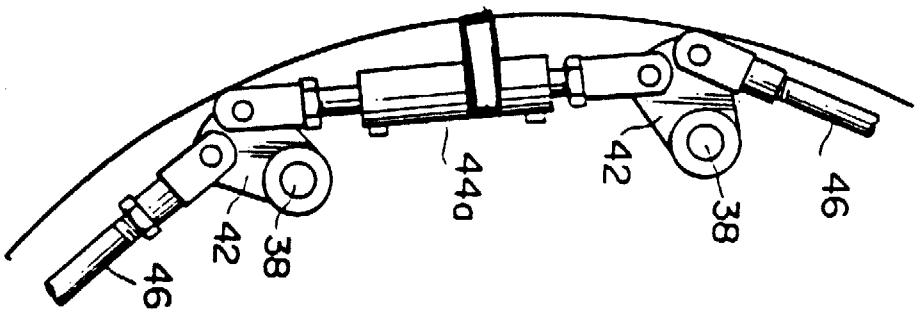

In the illustrated embodiment, a manual screw jack shown in FIG. 6(*a*) as being scaled up is used as the operating jack 44. Instead of this manual screw jack, a hydraulic jack 44*a* shown in FIG. 6(*b*) is also available. In the case where the bore of the pipe is large enough to permit a worker to enter in the pipe, the screw jack is advantageously used. However, in the case where the bore of the pipe is too small to permit the worker to operate the jack in the pipe, the hydraulic jack is used as the operating jack is to be remotely controlled. Also, while one operating jack is shown in the illustrated embodiment, a plurality of operating jacks operated at the same time could be used, if desired.

Since the operating mechanism 16 is basically composed of the generally rod-like operating jack 44 and the connecting members 46 for interconnecting the rod members 38, to which the hydraulic jacks 12 are fixed and supported, the operating mechanism 16 is located to generally conform to the circular or polygonal frame member 30, as shown in the drawings. Also, the rod members 38 interconnected through the operating jack 44 and the connecting members 46 are simultaneously rotated, so that all hydraulic jacks 12 are simultaneously swung.

Figure 4:
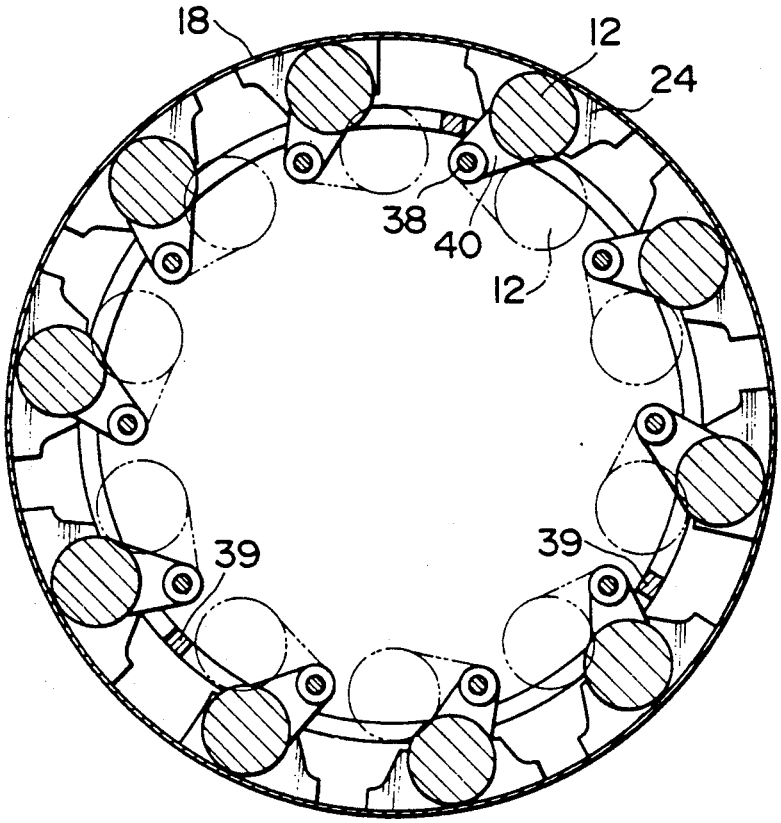
FIG. 4 is a sectional view taken along a line 4—4 in FIG. 1 and showing the operative position and the inoperative position of hydraulic jacks.
Figure 5:
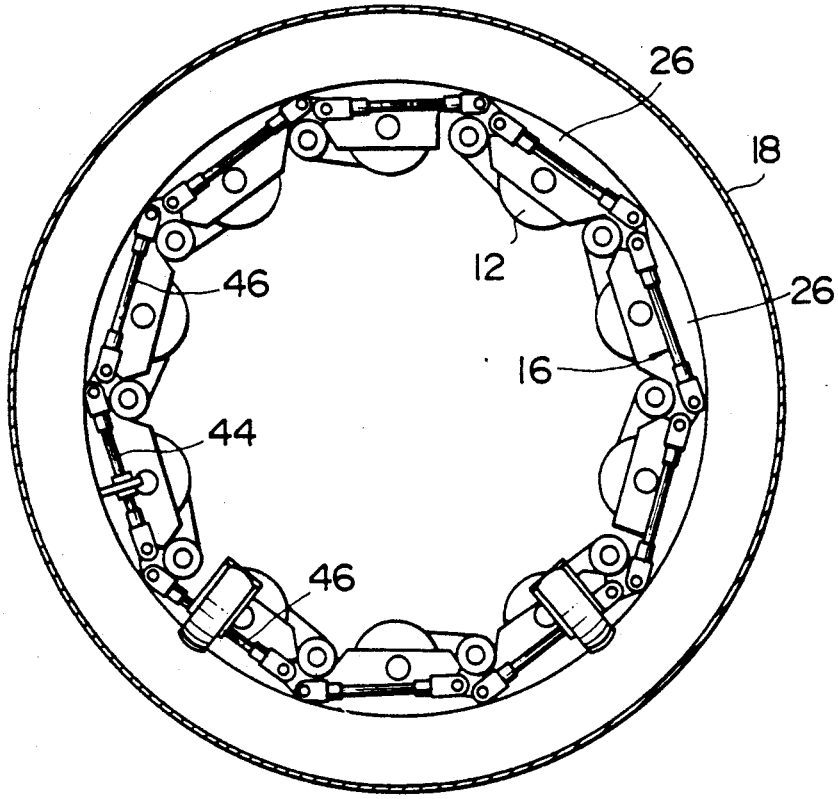
FIG. 5 is a sectional view similar to that of FIG. 3, but showing the hydraulic jacks at the inoperative position.

The intermediate pipe-jacking apparatus 10 is normally in the operative condition as shown in FIGS. 1 and 4, that is, at the operative position where the hydraulic jacks 12 are placed at the operative position between the end faces of the pipes 20,22, whereby the intermediate pipe jacking apparatus 10 is in a condition to be operated in any time toward the extended position shown by the imaginary line in FIG. 1 to propel the pipe 20. When the intermediate pipe-jacking apparatus 10 is to be removed from the pipe after the completion of predetermined propulsion of the pipe 20, the hydraulic jacks 12 are first made to perform the contraction or both of the extension and contraction so as to produce a gap between the end face of at least one pipe and the hydraulic jacks between the pipes 20,22. Then, the operating jack 44 of the operating mechanism 16 is operated to angularly rotate the rod members 38 around their own axes through the brackets 42. Accordingly, as shown in FIG. 4, all hydraulic jacks 12 fixed to the respective rod members 38 are angularly rotated together with the rod members, and then swung around the axes of the rod members 38 from the operative position (shown by the solid line in FIG. 4) between the end faces of the pipes 20,22 to thereby reach the inoperative position (shown by the imaginary line in FIG. 4) inside the pipes. Thus, after the hydraulic jacks 12 are shifted from the operative position on the frame 14 to the inoperative position, that is, the housing position, the rear pipe 22 is propelled by a basic propelling apparatus (not shown) to make the end faces of the pipes 20, 22 abut against each other. The intermediate pipe-jacking apparatus 10 is removed to the outside of the pipe after or before the abutting of the end faces of the pipes 20,22.

What is claimed is:

1. An intermediate pipe-jacking apparatus for use in the propulsion of pipes in the ground, comprising:

a movable frame spanning adjacent pipes and disposed in said pipes;

a plurality of hydraulic jacks supported by said frame and used for propelling the pipes;

an operating mechanism for shifting said hydraulic jacks between an operative position between the end faces of the adjacent pipes in a juxtaposed relationship for engaging the end faces and an inoperative position out of the juxtaposed relationship by being spaced diametrically inward and longitudinally away from the end faces of the adjacent pipes;

wherein said frame is provided with a pair of hollow end frame members located in the cross section of said pipes and substantially conforming to the inner peripheral surfaces of said pipes, said end frame members being spaced from one another, and a plurality of rod members rotatably supported by the end frame members;

said hydraulic jacks are respectively fixed to said rod members; and said operating mechanism is disposed adjacent one of said end frame members and rotates said rod members so as to shift said hydraulic jacks between said operative position and said inoperative position.

2. An intermediate pipe-jacking apparatus according to claim 1, wherein said operating mechanism is provided with a bracket fixed to one end of each of said rod members, and at least one operating jack and a plurality of connecting members for interconnecting the adjacent brackets.

3. An intermediate pipe-jacking apparatus according to claim 1, wherein each of said end frame members has a generally circular shape as a whole.

4. An intermediate pipe-jacking apparatus according to claim 1, wherein each of said end frame members is formed of at least one shaped steel element having a generally circular shape.

5. An intermediate pipe-jacking apparatus according to claim 1, wherein said operating mechanism is provided with at least one operating jack.

6. An intermediate pipe-jacking apparatus according to claim 5, wherein said at least one operating jack is a screw jack.

7. An intermediate pipe-jacking apparatus according to claim 5, wherein said at least one operating jack is a hydraulic jack.

8. An intermediate pipe-jacking apparatus according to claim 1, wherein said frame is further provided with a reinforcing member extending between both end frame members and mounted to both end frame members.

9. An intermediate pipe-jacking apparatus according to claim 1, wherein each of said end frame members is a shaped steel element having a generally circular shape.

* * * * *

UNITED STATES PATENT AND TRADEMARK OFFICE

CERTIFICATE OF CORRECTION

PATENT NO. : 5,013,189

DATED : May 7, 1991

INVENTOR(S) : Toshio Akesaka

It is certified that error appears in the above-identified patent and that said Letters Patent is hereby corrected as shown below:

In the Drawing:
Figure 6(b) should be deleted to appear as Figure 6(b) as shown on the atached page.

Signed and Sealed this

Sixth Day of October, 1992

*Attest:*

DOUGLAS B. COMER

*Attesting Officer*

*Acting Commissioner of Patents and Trademarks*